United States Patent [19]

Sklyarov et al.

[11] Patent Number: 4,472,257

[45] Date of Patent: Sep. 18, 1984

[54] ELECTRODE FOR ELECTROCHEMICAL PROCESSES AND PROCESS FOR PRODUCING SAME

[76] Inventors: Alexandr T. Sklyarov, ulitsa Zhivopisnaya, 17, kv. 26; Viktor P. Archakov, ulitsa Vavilova, 20, kv. 47; Valentin I. Eberil, Festivalnaya ulitsa, 46, kv. 188; Vladimir L. Kubasov, Kirovogradskaya ulitsa, 4, korpus 2, kv. 135; Inna V. Borinevich, ulitsa Ulyanovskaya, 34, kv. 48; Asya I. Marchenkova, ulitsa Pyatnitskaya, 9/28, kv. 2, all of Moscow; Vyacheslav S. Sitanov, ulitsa Mira, 6, kv. 13, Volgograd; Vladimir I. Fisin, ulitsa 50-letiya Oktyabrya, 28, kv. 120, Volgograd; Nikolai F. Mokhov, ulitsa 50-letiya Oktyabrya, 47, kv. 245, Volgograd; Leonid Y. Tsybin, ulitsa Fadeeva, 20, kv. 160, Volgograd, all of U.S.S.R.

[21] Appl. No.: 466,732

[22] Filed: Feb. 16, 1983

Related U.S. Application Data

[63] Continuation of Ser. No. 144,852, Apr. 29, 1980, abandoned.

[51] Int. Cl.[3] ..... C25B 11/00

[52] U.S. Cl. ..... 204/290 R; 204/292; 204/294

[58] Field of Search ..... 204/290 R, 290 F, 294, 204/292

[56] References Cited

U.S. PATENT DOCUMENTS

| | | | |
|---|---|---|---|
| 3,922,226 | 11/1975 | Entwisle | 204/290 F |
| 3,972,732 | 8/1976 | Hausler | 429/218 |
| 4,235,695 | 11/1980 | de Norr et al. | 204/268 |

FOREIGN PATENT DOCUMENTS

| | | |
|---|---|---|
| 95463 | 6/1960 | Czechoslovakia . |
| 150398 | 9/1973 | Czechoslovakia . |

*Primary Examiner*—John F. Niebling

*Attorney, Agent, or Firm*—Murray Schaffer

[57] ABSTRACT

An electrode for electrochemical processes comprising a graphite base having, in its pores, metals or compounds of metals possessing electrocatalytical properties and being in an electric contact with graphite; an electrochemically inert organic compound insoluble in the electrolyte and having its dropping point and/or the temperature of transition to the gas state exceeding the electrode temperature during electrolysis.

A process for producing the electrode of the present invention comprises introduction, into the graphite base pores, successively metals or oxides of metals possessing electrocatalytic properties, and then an electrochemically inert organic compound insoluble in the electrolyte and having its dropping point and/or the temperature of transition to the gas stage exceeding the electrode temperature during electrolysis.

15 Claims, No Drawings

ELECTRODE FOR ELECTROCHEMICAL PROCESSES AND PROCESS FOR PRODUCING SAME

This is a continuation of Ser. No. 144,852 filed Apr. 29, 1980, now abandoned.

FIELD OF THE INVENTION

The present invention relates to electrochemical processes and, more specifically, to an electrode therefor.

At the present time, in the manufacture of chlorine in electrochemical processes with a solid and liquid cathode, as well as in the production of chlorates, hypochlorite and other products, use is made of graphite anodes which, however, have disadvantages residing in a short service life and the formation of a considerable amount of slime during the electrolysis.

BACKGROUND OF THE INVENTION

During the recent decade an ever growing application is enjoyed by electrodes comprising a metal base with deposited thereonto a thin coating of a compound possessing electrocatalytic properties.

Thus, known in the art are electrodes comprising a current-conducting substrate of titanium, niobium, tantalum, zirconium and a coating deposited thereonto and resistant against the electrolyte and the electrolysis products; said coating consists of a mixture of one or more oxides of film-forming metals such as aluminium, tantalum, titanium, zirconium, niobium, bismuth and tungsten with one or more metals such as palladium, platinum, rhodium, iridium, ruthenium, osmium, gold, silver, iron, nickel, chromium, lead, copper, manganese, oxides of these metals, nitrides, carbides sulphides thereof and their mixtures as well (cf. USSR Inventor's Certificate No. 369923).

These electrodes have substantial advantages over the prior art graphite electrodes. The principal advantages of the metal-oxide electrodes over graphite ones reside in the following:

1. a considerably longer service life of electrodes;
2. stable dimensions of electrodes excluding the voltage increase with time during electrolysis in processes with a solid cathode and avoiding the need in adjusting the electrode position to maintain a constant voltage in electrolyzers with a mercury cathode;
3. the absence of slime contaminating the membrane.

However, despite the above-mentioned advantages, a wide application of metal-oxide anodes is restricted first of all by a high production cost thereof as compared to that of graphite electrodes.

An essential disadvantage of metal-oxide anodes resides also in a high sensitivity thereof to shortings which restricts a broad application thereof in electrolyzers with a mercury cathode.

For this reason, numerous attempts have been taken to develop graphite electrodes possessing improved operation characteristics.

Known in the art are graphite electrodes impregnated with different electrochemically inert organic substances such as products of polymerization of oils (cf. Canadian Pat. No. 602053), polyester resin (Czechoslovakian Pat. No. 95463), allyl resins (Japanese Pat. No. 48-15149, Cl.13/7 D 131), products of polymerization of tall stand oil (cf. USSR Inventor's Certificate No. 167832).

In practicing of graphite electrodes impregnated with electrochemically inert organic substances as anodes for chlorine electrolyzers, the anode stability is increased by not more than 1.5 times as compared to anodes from a non-impregnated graphite.

A disadvantage of these anodes is in limited allowable operating current densities (for example, not more than 1.5 $kA/m^2$ in the production of chlorine with a solid cathode and not more than 8–9 $kA/m^2$ in the production of chlorine by processes with a mercury cathode). At higher current densities, an accelerated destruction of the anode is possible due to a surpassed critical swelling potential. The reason for limitation of a working current density of such electrodes resides in a higher potential of the anode after impregnation thereof with an inert organic substance. For the electrode impregnated so that all its pores are totally closed (which is most advantageous from the standpoint of lowering the inside wear), the permissible current density is substantially lower than the one employed in modern electrolyzers.

Also known in the art are graphite based electrodes, wherein the porous graphite base contains, either on the surface or in pores thereof, metals or metal compounds possessing electrocatalytical properties. Thus, known is an electrode comprising a current-conducting base of graphite with a coating consisting of a mixture of one or more oxides of the following film-forming metals: aluminium, titanium, tantalum, zirconium, niobium, bismuth and tungsten with one or more of the following metals: palladium, platinum, rhodium, iridium, ruthenium, osmium, gold, silver, iron, nickel, chromium, lead, copper, manganese; oxides of these metals, their nitrides, carbides, sulphides, as well as mixtures thereof (of USSR Inventor's Certificate No. 369923).

Known are also electrodes with an electroconducting (including graphite) base coated with oxides of metals of the platinum group added with oxides of non-noble metals such as tin (cf. FRG Application No. 2,710,802), $\beta$-manganese dioxide (cf. FRG Application No. 2,636,447), cobalt oxides of the general formula $Co_3O_4$ (cf. USSR Inventor's Certificate No. 492301).

These electrodes are considerably cheaper than those having a metal base and their wear during the initial operation period (generally about one month) is substantially lower than wear of a graphite anode impregnated with an electrochemically inert organic compound. However, with lapse of time, the process becomes occurring substantially totally on the graphite due to a broken contact "electrocatalytic compound-graphite" and the anode is subjected to wear in much the same manner as a non-treated graphite anode. This disadvantage of graphite anodes containing electrocatalytic compounds is responsible for the fact that said anodes have not obtained any practical application.

It is an object of the present invention to provide such a graphite electrode which would possess a long service life and could operate at commercial current density values.

BRIEF SUMMARY OF THE INVENTION

This object is accomplished by that an electrode consisting of a porous graphite base having metals or metal oxides possessing electrocatalytic properties and being in contact with graphite in its pores, in accordance with the present invention contains an electrochemically inert organic compound insoluble in the electrolyte in at least a portion of pores of the graphite base, said organic compound having its dropping point and or the temperature of transition to the gas state above the electrode temperature during the electrolysis.

It is quite obvious that substances which are solid at the above-specified temperature do satisfy this requirement.

DETAILED DESCRIPTION OF THE INVENTION

As the electrochemically inert organic compound, the electrode contains compounds selected from the group consisting of carbochain polymers, heterochain polymers, naturally-occurring gums and synthetic resins, bitumens, pitches, products of polymerization of oils and stand oils, as well as mixtures of said compounds.

Among the group of the carbochain polymers as the inert organic compound according to the present invention, the electrode may contain, in particular, polystyrene, polyethylene, polymethylmethacrylate, polyvinylchloride.

Among the group of heterochain polymers, the electrode may contain polyesteracrylate.

Out of the group of naturally-occurring gums and synthetic resins, the electrode may contain rosin, phenol-formaldehyde, furan and polyester resins.

Out of the group of bitumens, the electrode may contain oxidized petroleum bitumens.

Out of the group of pitches, use may be made in the electrode of a coal-tar pitch.

Out of the group of products of polymerization of oils and stand oils, the electrode may contain a product of copolymerization of tall oil and lin-seed oil and a product of polymerization of tall stand oil.

The above-mentioned list of compounds does not limit the scope of all possible particular compounds which can be used as an inert impregnation agent for the electrode according to the present invention.

These compounds may be contained in the electrode composition both individually and in all possible combinations thereof.

As the metals or compounds of metals possessing electrocatalytic properties, the electrode may contain substantially any metals, simple and mixed oxides of metals, as well as mixtures of oxides and metals, mixtures of different oxides with each other and mixtures of oxides with other compounds of metals possessing an overtension of the basic electrode reaction which is below or at least equal to the overtension of this reaction on graphite and breaking at the rate which is not faster than that of graphite under the electrolysis conditions.

As said electrocatalytic compounds the electrode may contain such metals as platinum, palladium, iridium, ruthenium, mixtures thereof, alloys and oxides, as well as oxides of gold, silver, iron, cobalt, nickel, chromium, copper, lead, manganese both separately or in various combinations thereof, as well as in a mixture with oxides of film-forming metals such as titanium, tantalum, zirconium, aluminium, bismuth, tungesten, niobium, with compounds of tin, vanadium, molybdenum, silicon, carbon, phosphorus, boron and sulphur.

A high stability of the electrode according to the present invention is explained by that the electrochemically inert organic compound not only protects the surface of inner pores of the electrode from any electrochemical or chemical destruction, but also ensures a durable and reliable contact of the electrocatalytic compound with graphite.

At the same time, the presence in pores and at the surface of graphite of said electrocatalytic compound having a lower, as compared to that of graphite, overvoltage of the basic electrode reaction, as well as the presence of said inert organic compound, makes it possible to substantially reduce the value of the true surface area of the electrode which is in contact with the electrolyte. Therefore, use may be made of an electrode containing a higher amount of an inert organic compound than the prior art electrodes, without surpassing the critical swelling potential.

The process for the manufacture of the electrode for electrochemical processes according to the present invention comprises introduction, into at least a portion of pores of the graphite base, or at least one metal and/or a compound of a metal possessing electrocatalytic properties, followed by introduction, into at least a portion of pores of said graphite base, of an electrochemically inert organic compound which has its dropping point and or the temperature of the transition to the gas state above the electrode temperature during the electrolysis.

The introduction of said organic compound may be effected by any conventional method, but the most preferred method is impregnation which is the simpliest and most accessible technique.

To carry out the impregnation, use is made of solutions of the organic compound with which the graphite base should be impregnated, followed by the removal of the solvent; in another embodiment, the graphite base is impregnated with a melt of said organic compound, followed by cooling to the dropping temperature of this compound.

The organic compound meeting the above-specified requirements may be prepared directly inside the pores of the graphit base by way of impregnation thereof with a liquid monomer such as styrene or with a liquid oligomer, followed by polymerization or polycondensation.

For the impregnation of the graphite base, use may be made of solutions of polystyrene, polyvinylchloride, polymethylmethacrylate, polyethylene or melts of oxidized petroleum bitumen, coal-tar pitch, rosin or other suitable compounds.

As the graphite, use is made of porous graphite, wherefrom a base (or block) of any desired size is cut out. This base is set under vacuum and impregnated first with solution of the above-indicated compounds of metals, followed by drying and heat-treatment, whereafter impregnation is effected using a solution or a melt of said organic compound.

Metals or metal compounds possessing electrocatalytic properties may be introduced into pores of the graphite base by, for example, impregnation thereof with solutions of metal compounds, followed by drying and heat-treatment, deposition of metals or compounds thereof from the gas phase, impregnation with molten metals or by any other conventional techniques.

Depending on the conditions of electrolysis, properties of the electrocatalytic compound and the quality of graphite, the electrode may be produced either with a substantially total closing of pores with the inert compound (impregnation from a melt, impregnation with a liquid monomer with a subsequent block-polymerization thereof inside the electrode pores), or with only a partial filling of pores (impregnation with solutions in volatile solvents).

The practical application of the electrode according to the present invention provides the following technical effects.

The use of the electrode in electrochemical processes instead of conventional graphite anodes makes it possible to prolong, by several times, the service life of anodes and reduce the electric power consumption rate without, however, resorting to re-arrangement of the existing electrolyzers; it also makes possible to avoid the use of expensive and hardly available metals as the base, e.g. titanium.

The electrode according to the present invention is resistant to shortings in substantially much the same manner as a conventional graphite electrode, which constitutes an advantage over metallic electrodes wherein their active coating is dissolved upon shortings and the metal base is damaged. This enables operation of electrolyzers without using systems of protection from shortings and apply less severe requirements to the electrolyte and mercury purity as compared to electrolyzers provided with anodes having a metal base. These advantages of the electrode according to the present invention would not be obtained unless the required sequence of introduction of an electrocatalytic compound and an electrochemically inert organic compound into pores of the graphite base is strictly obeyed.

The above-specified sequence of operations is mandatory in practicing the process according to the present invention: in the case of an inverted sequence of operations, i.e. upon introduction first of an electrochemically inert compound, provided that it fills the total volume of open pores of the graphite base, the introduction of an electrocatalytic compound becomes impossible. If the graphite base is impregnated with the organic compound only partially, then upon a subsequent introduction of the electrolytical compound, its electrical contact with the graphite base is hindered and not protected from the detrimental effect of the electrolyte and the electrolysis products; in this case, the rate of destruction of the electrode does not substantially differ from the rate of destruction of the untreated graphite base, which is further proven by one of the illustrative examples given hereinbelow.

Therefore, as follows from the foregoing, the sequence of operations in the process according to the present invention is not at all obvious in view of the prior art.

For a better understanding of the present invention, some specific examples illustrating the electrode according to the present invention in comparison with the prior art electrodes are given hereinbelow.

Example 1

A graphite electrode according to the present invention with the dimensions of 50×50×100 mm has a graphite base with a porosity of 20%. The electrode is manufactured in the following manner. From a plate of electrode graphite, a block (base) is cut out with the dimensions of 50×50×100 mm. The graphite block is set under vacuum and then impregnated with an aqueous solution of $Co(NO_3)_2$ having concentration of 125 g/l, whereafter it is dried by gradually elevating temperature to 140° C. and calcined for 10 minutes at 300° C. Afer calcination, the graphite block is set under vacuum and then impregnated with a solution of polystyrene in styrene with the concentration of 90 g/l under the pressure of 10 atm. g., dried for 3 hours while gradually elevating temperature from 80° to 160° C., whereafter the impregnation with the solution of polystyrene and drying is repeated for one more time.

The thus-manufactured electrode contains 0.5% of $Co_3O_4$ and 1.5% of polystyrene (polystyrene is a solid compound at a temperature of up to 90° C.). The electrode is tested as an anode in a laboratory-type electrolyzer in electrolysis of a solution of NaCl with a concentration of 280–300 g/l at a temperature within the range of from 80° to 85° C. and a pH=2.5–3; the current passed through the anode is 125 A (the current density is 5 kA/cm$^2$). The electrode temperature during electrolysis here in the Examples hereinbelow exceeds the electrolyte temperature by not more than 5° C.

The electrode weight loss (wear) for the first 10 days of the tests is 15.3 g, for the second 10 days—34.4 g and over the third 10 days—38.9 g which corresponds to the wear rate of 0.0005 g/A.hr, 0.00115 g/A.hr and 0.001295 g/A.hr, respectively.

For the purpose of comparison there have been carried out tests of the prior art graphite electrodes containing $Co_3O_4$ or impregnated with polystyrene, as well as of an electrode from graphite not subjected to a special treatment.

A graphite electrode having the same dimensions as the one described hereinabove with a base made of the same graphite and containing 0.5% of $Co_3O_4$ in its pores has been subjected to tests under the conditions described hereinabove. The introduction of $Co_3O_4$ is effected in manner similar to the above-described. Weight decrease of the electrode over the first 10 days of the tests is 18.7 g, over the second 10 days—53.5 g, over the third 10 days—74.6 g.

A graphite electrode having the same dimensions and the base of the same graphite containing 1.5% of polystyrene in its pores is tested under the above-described conditions. The introduction of polystyrene is effected following the above-described procedure. The content of polystyrene of 1.5% has been selected because it provides the maximum wear decrease for a given type of graphite under the conditions of tests for the case of impregnation with polystyrene only. The weight decrease of the electrode over the first 10 days of the tests was 31.3 g, over the second 10 days—49.2 g, over the third 10 days—54.8 g.

A graphite electrode of the same dimensions as the above-described, made of the same graphite and subjected to no special treatment (i.e. identic to the base of the above-described electrodes) is tested under the above-mentioned conditions. The electrode weight decrease over the first 10 days of the tests is 55.2 g, over the second 10 days—75.0 g, over the third 10 days—82.1 g.

Example 2

A graphite electrode according to the present invention having the same dimensions as in Example 1 hereinbefore incorporates a graphite base with the porosity of 20%. $Co_3O_4$ is introduced into the graphite block following the procedure described in Example 1, whereafter the block is impregnated with styrene. The impregnation is also conducted following the procedure of the foregoing Example 1. After the impregnation with styrene, the block is gradually heated to polymerized styrene by elevating temperature from 100° to 140° C. within the period of 35 hours. The thus-manufactured electrode contains 0.5% of $Co_3O_4$ and 9% of polystyrene (polystyrene and $Co_3O_4$ occupy substantially all volume of open pores of the graphite). The electrode is tested under the conditions described in Example 1. The electrode weight decrease within the first 10 days of the tests was 17.2 g, over the second 10 days it was 21.4 g, over the third 10 days—21.6 g.

For the purpose of comparison, an electrode produced by the prior art process is subjected to similar tests. To this end, a graphite electrode of the same dimensions as described hereinabove, with the base made of the same graphite and containing 9% of polystyrene in its pores is tested under the conditions of Example 1. The introduction of styrene and polymerization thereof are effected as described in the foregoing Example 2. After the first 10 days of tests the electrode was completely broken.

Example 3

A graphite electrode according to the present invention having the same dimensions as in Example 1 hereinbefore has a graphite base with the porosity of 20%. $Co_3O_4$ is introduced into the graphite block as in Example 1, then the graphite block is set under vacuum and impregnated with a molten oxidized petroleum bitumen (OPB) heated to a temperature of from 220° to 230° C. under the pressure of 10 atm.g.: dropping point of the OPB is 135° C. (Here and afterwards the dropping point is determined by the Ubbelonde method, see Polymeric Encyclopaedia, Moscow, Sovetskayja Encyclopedia Publishing House, 1974 vol, I, page 934). The thus-manufactured electrode contains 0.5% of $Co_3O_4$ and 9% of OPB (OPB and $Co_3O_4$ occupy almost all volume of open pores of the graphite). The electrode is then tested under the conditions described in Example 1. The electrode weight loss for the first 10 days of the tests is 19.3 g, over the second 10 days—21.6 g, over the third 10 days—21.7 g.

For the purpose of comparison, an electrode produced by the prior art process is subjected to similar tests. To this end, a graphite electrode with the same dimensions as those described hereinabove and the same graphite base containing 9% of OPB in its pores is tested under the conditions of Example 1. The introduction of OPB is effected as described in the foregoing Example 3. For the first 10 days of the tests the electrode was totally broken.

Example 4

A graphite electrode according to the present invention having the same dimensions as in Example 1 incorporates a graphite base of the porosity of 20%. The graphite block is impregnated with an aqueous solution of $RuCl_3$ and $TiCl_3$ of the concentration of 65 g/l as calculated for $RuO_2$ and 79.5 g/l as calculated for $TiO_2$ and then dried. The impregnation and drying are conducted in a manner similar to that in the impregnation with the solution of $Co(NO_3)_2$ in Example 1, After drying, the graphite block is set under vacuum and impregnated under the pressure of 20 atm.g. with a mixture of the following composition (parts by weight): an unsaturated polyester resin of the maleinate type modified with resin 50, styrene 47, isopropylbenzoyl hydroperoxide 3. To cure the resin, the block is gradually heated to 100° C. and maintained for 5 hours at this temperature.

The thus-produced electrode contains 1.3% of the mixture of ruthenium oxide and titanium oxide and 10% of polyester resin (which is a solid substance at the temperature of electrolysis). The resin and the oxide occupy substantially total volume of open pores of graphite. The electrode is tested under the conditions described in the foregoing Example 1. The electrode weight decrease to the first 10 days of the tests is 18.3 g, for the second ten days—23.2 g, for the third 10 days—25.4 g.

Example 5

A graphite electrode according to the present invention having the same dimensions as in Example 1 hereinbefore has a graphite base with the porosity of 20%. The graphite block is impregnated with an aqueous solution of $H_2PtCl_6$ with the concentration of 55 g/l as calculated for the metal. The impregnation is effected in much the same manner as the impregnation with an aqueous solution of $Co(NO_3)_2$ in Example 1. The impregnated block is dried for two hours at the temperature of 100° C. and then calcined in the atmosphere of argon for 1 hour at the temperature of 550° C.

After the introduction of platinum the graphite block is set under vacuum and impregnated, at the temperature of 130° C. under the pressure of 10 atm. g. with rosin having the dropping point of 70° C. The thus-produced electrode contains 0.5% of platinum and 9% of rosin. The electrode is tested as an anode of a cathodic protection unit in water containing 35 mg/l of $Cl^-$ and 40 mg/l of $SO_4^{2-}$ at the anodic current density of 250 $A/m^2$ and at a temperature of from 16° to 21° C. The rate of wear of the electrode is equal to 0.048 g/A.hr.

Example 6

A graphite electrode of the same dimensions as the one described above is manufactured from the same graphite and subjected to no special treatment. This electrode is tested under the conditions described hereinabove in this Example. The rate of wear of the electrode is 0.128 g/A.hr.

A graphite electrode according to the present invention with the dimensions of 40×40×12 mm has a graphite base with the porosity of 27%. The electrode is produced in the following manner. From a plate of electrode-grade graphite a block with the dimensions of 40×40×12 mm is cut out. The introduction of $Co_3O_4$ is effected as in Example 1, though the concentration of the solution of $Co(NO_3)_2$ is 500 g/l; after the first calcination of the block the operations of impregnation and calcination are repeated once more.

After the second calcination, the graphite block is set under vacuum and impregnated with a solution of tall stand oil in $CCl_4$ containing 15% by volume of the tall drying oil and a lead-manganese siccative in the amount of 0.45% as for pyrolusite and 0.9% of lead oxide by weight of the drying oil; then the block is dried under vacuum for 3 hours at room temperature, 3 hours with a gradual elevation of temperature from room temperature to 90° C. and to a constant weight at 90° C. without vacuum. The thus-manufactured electrode contains 8% of $Co_3O_4$ and 3% of the product of polymerization of tall stand oil (decomposes with the formation of gaseous products above 260° C.). The electrode is tested under the conditions of production of sodium chlorate in an electrolyte containing 130 g/l of NaCl, 450 g/l of $NaClO_3$ and 2 g/l of $Na_2CrO_4$ at a pH=6.6 to 7.6, temperature of 40° C. and current of 5.1 A. The electrode weight decrease for the first 10 days of the tests was 0.9 g, for the second 10 days—1.2 g, for the third 10 days—1.3 g.

For the purpose of comparison, there are tested under the same conditions the prior art electrodes, as well as an electrode of graphite subjected to no special treatment and a graphite electrode produced by the process with a reversed sequence of operations.

A graphite electrode having the same dimensions as the one described hereinabove and the same graphite base containing 8% of $Co_3O_4$ in its pores is tested under the above-mentioned test conditions. The introduction of $Co_3O_4$ is effected as in Example 6. The electrode weight loss for the first 10 days of the test is 1.5 g, for the second 10 days—2.7 g, for the third 10 days—4.6 g.

A graphite electrode having the same dimensions as the above-described with the same graphite base containing in its pores 3% of a product of polymerization of tall stand oil is tested under the above-described conditions. The impregnation with the solution of tall stand oil and the heat-treatment is conducted as described hereinbefore. The electrode weight loss for the first 10 days of the tests is 1.1 g, for the second 10 days—1.9 g, for the third 10 days—2.4 g.

A graphite electrode of the same dimensions as described above, with the same graphite base non-subjected to any special treatment is tested under the conditions mentioned above. The electrode weight loss for the first 10 days of tests is 2.4 g, for the second 10 days—2.8 g, for the third 10 days—4.6 g.

Into a graphite base of the dimensions described hereinbefore produced from the same graphite there is introduced a product of polymerization of tall stand oil as described in Example 6, whereafter $Co_3O_4$ is added following the procedure of the foregoing Example 6.

The thus-made electrode is tested under the conditions similar to those employed hereinbefore. The electrode weight loss for the first 10 days of tests is 2.2 g, for the second 10 days—2.75 g, and for the third 10 days—4.6 g.

Example 7

A graphite electrode according to the present invention with the same dimensions as those in Example 6 has a graphite base with porosity of 27. $Co_3O_4$ is introduced into the graphite block as in Example 6, whereafter the graphite block is set under vacuum and impregnated with a mixture having the following composition (parts by volume): tall oil 10.5, linseed oil 4.5, $CCl_4$ 85, which is added with a lead-manganese siccative in the amount of 0.5% for pyrolusite and 1.0% for lead oxide by weight of the tall oil. Thereafter, the block is dried in much the same manner as after drying with a solution of tall drying oil (Example 6). The thus-manufactured electrode contains 8% of $Co_3O_4$ and 3% of the product of copolymerization of tall oil (decomposes with the formation of gaseous products above 260° C.). The electrode is tested under the conditions described in Example 6 hereinbefore.

The electrode weight loss for the first 10 days of the tests is 0.7 g, for the second 10 days—1.3 g, for the third 10 days—1.5 g.

Example 8

A graphite electrode according to the present invention with the dimensions as in Example 1 has the graphite base with the porosity of 20%. The graphite block is impregnated with an aqueous solution containing 17.5 g/l of $RuCl_3$ and 30 g/l of $Fe(OH)_3$ prepared by precipitation from a solution of $FeCl_3$ by ammonia. The impregnation is conducted as in the case of impregnation with a solution of $Co(NO_3)_2$ in Example 1, whereafter the graphite block is dried for one hour at the temperature of 100° C., then the temperature is elevated uniformly to 450° C. over one hour and the block is maintained at this temperature for one hour.

The thus-treated block is impregnated with an oligoesteracrylate based on phthalic anhydride, triethylene glycol and methacrylic acid containing 2% of benzoyl peroxide. The impregnation is conducted in much the same manner as the impregnation with styrene in Example 2. To form a polyesteracrylate, the block is maintained for three hours at the temperature of 80° C. and for three hours at 100° C. The thus-produced electrode contains 0.3% of a mixture of oxides of ruthenium and iron and 10.5% of a polyesteracrylate (which is a solid product at the electrode temperature during electrolysis). The electrode is tested under the conditions described in Example 1. The weight loss of the electrode for the first 10 days of tests was 20.2 g.

Example 9

A graphite electrode according to the present invention with the same dimensions as in Example 1 has a graphite base with the porosity of 20%. The graphite block is successively impregnated first with an aqueous solution of $Mn(NO_3)_2$ of the concentration of 52 g/l, followed by drying for 1 hour at 100° C. and calcination for 10 minutes at 190° C., and then impregnated with an aqueous solution of $Co(NO_3)_2$ with the concentration of 65 g/l, followed by drying and calcination. The impregnation with aqueous solutions, as well as drying and calcination after impregnation with the solution of $Co(NO_3)_2$ are conducted following the procedure described in Example 1.

The thus-treated block is set under vacuum and dipped into a molten resol-type phenol-formaldehyde resin heated to the temperature of 80° C., whereafter, over the molten resin there is created the pressure of argon of 10 atm.g. and impregnation is carried out under these conditions of temperature and pressure for two hours. Then the graphite block is extracted from the resin, the excessive resin is removed from its surface and then the block is subjected to a heat treatment to cure the resin while gradually elevating temperature from 80° to 130° C. at the rate of 3° C./hr.

The thus-produced electrode contains 0.5% of a mixture of $MnO_2$ and $Co_3O_5$ in the ratio of 1:1 and 7% of the phenolformaldehyde resin (which is a solid product at the electrode temperature during electrolysis). The electrode is tested under the conditions described in Example 1. The electrode weight loss for the first 10 days of tests is 18.5 g, for the second ten days—20.2 g, for the third ten days—20.6 g.

Example 10

A graphite electrode according to the present invention with the same dimensions as in Example 1 has a graphite base with the porosity of 20%. The graphite block is impregnated with a solution of $RuCl_3$ of the concentration of 35 g/l with a subsequent heat-treatment. The impregnation and heat-treatment are effected in much the same manner as in the case of introduction of a mixture of oxides of ruthenium and iron (Example 8). Then the graphite block is immersed into a boiling solution of polyethylene in $CCl_4$ with the concentration of 110 g/l and heated at reflux for 4 hours, whereafter impregnation with this polyethylene solution is effected under the pressure of 10 atm.g. at the temperature of 75° C. for 4 hours. After the impregnation, the graphite block is dried for 1 hour at 70° C., one hour at 100° C.

and 1 hour at 200° C. The thus-produced electrode contains 0.2% of $RuO_2$ and 1% of polyethylene (which is a solid product at the electrode temperature during electrolysis). The electrode is tested as an anode in a laboratory electrolyzer to produce sodium hypochlorite. The electrolyte contains 90 g/l of NaCl and 10 g/l of NaClO; the electrolysis is conducted at the temperature of 25° C., and the current density of 2 kA/m$^2$. The electrode weight decrase for 10 days of tests is 63 g.

For the purpose of comparison, an electrode of the same dimensions and made of the same graphite subjected to no special treatment is tested under the same conditions. The electrode weight decrase for 10 days of tests is 150 g.

Example 11

A graphite electrode according to the present invention with the same dimensions as in Example 1 has a graphite base with the porosity of 20%. Into the graphite block, $RuO_2$ is introduced following the procedure of Example 10, whereafter the block is set under vacuum and impregnated with a mixture of mono- and difurfurylidenacetone in the ratio of 3:2 containing 5% of para-toluenesulphochloride.

The impregrnated block is heated for one hour from room temperature to 80° C., then from 80° to 150° C. at the rate of 10° C./hr and maintained for three hours at 150° C.

The thus-produced electrode contains 0.2% of $RuO_2$ and 8.5% of furan resin (solid product at the electrode temperature during electrolysis). The electrode is tested under the conditions described in Example 5 hereinbefore. The rate of wear of the electrode is 0.056 g/A.hr.

Example 12

A graphite electrode according to the present invention with the same dimensions as in Example 1 has a graphite base with the porosity of 20%. Into the graphite block, platinum is introduced following the procedure described in Example 5. Thereafter, the block is impregnated with a 2% solution of polyvinylchloride in cyclohexanone (the impregnation procedure is effected as in the case of impregnation with a solution of polystyrene in Example 1) and dried for three hours at the temperature of 90° C. The operations of drying and impregnation are repeated while increasing, each time, the drying duration by 1 hour until a weight gain of 2% (by weight of the graphite base) is obtained.

The thus-produced electrode contains 0.5% of platinum and 2% of polyvinylchloride (polyvinylchloride is decomposed with the formation of gaseous products at a temperature of above 90° C.). The electrode is tested under the conditions described in the foregoing Example 1. The electrode weight loss for the first 10 days of tests is 16.7 g, for the second 10 days—31.3 g, for the third 10 days—33.2 g.

Example 13

A graphite electrode according to the present invention with the same dimensions as in Example 6 hereinbefore has a graphite base with the porosity of 20%. The graphite block is set under vacuum and impregnated with an aqueous solution of $Na_2SiO_3$ with the concentration of 20 g/l, dried for one hour at the temperature of 100° C. and for one hour at 150° C., boiled for two hours in a concentrated hydrochloric acid, for 2 hours in water and dried for one hour at 150° C., whereafter $RuO_2$ is introduced into the graphite block as described in Example 10.

Afterwards, the graphite block is set under vacuum and impregnated with a solution of polymethylmethacrylate in cyclohexanone with the concentration of 20 g/l under the pressure of 20 atm.g. and then the block is dried for two hours at the temperature of 150° C. and for one hour at 170° C. The impregnation with the solution of polymethylmethacrylate and drying are repeated until a weight gain of 1.2% is obtained.

The thus-produced electrode contains 0.1% of $SiO_2$, 0.2% of $RuO_2$ and 1.2% of polymethylmethacrylate. The electrode is tested under the conditions described in Example 6.

The electrode weight loss after the first 10 days of tests is 1.0 g, for the second ten days—1.5 g, for the third days—1.7 g.

Example 14

A graphite electrode according to the present invention with the same dimensions as in Example 1 has a graphite base with the porosity of 20%. The graphite block is impregnated with an aqueous solution containing 41.5 g/l of $Co(NO_3)_2$ and 97.2 g/l $Al(NO_3)_3$; the impregnation is carried out following the procedure of impregnation with the solution of $Co(NO_3)_2$ in Example 1. The impregnated block is gradually heated to the temperature of 120° C., maintained for one hour at 120° C., then progressively heated to 450° C. and maintained at this temperature for 2 hours. Then 0.2% of $RuO_2$ is introduced into the graphite base following the procedure of Example 10. The thus-treated graphite block is set under vacuum and then impregnated with a coal-tar pitch (the dropping point thereof is 95° C.) heated to 220° C. under the pressure of 10 atm.g.

The thus-produced electrode contains 0.5% of a mixture of oxides of aluminium and cobalt, 0.2% of $RuO_2$ and 11.5% of coal-tar pitch. The electrode is tested under the conditions described in Example 1 hereinbefore. The electrode weight loss for 10 days of tests is 22.5 g.

Example 15

A graphite electrode according to the present invention with the same dimensions as in Example 6 has a graphite base with the porosity of 27%. Into the graphite base there are introduced 2.4% of a mixed oxide of ruthenium and titanium by means of impregnation with an aqueous solution of $RuCl_3$ and $TiCl_3$, followed by drying and calcination as described in Example 4. Then into the base there is introduced 1% of a mixture of paraffin with the dropping point of 55° C. and polyethylene in the ratio of 1:1 by means of impregnation with a solution of 55 g/l of polyethylene and 55 g/l of paraffin in $CCl_4$; the impregnation and drying operations are conducted as in the case of introduction of polyethylene in Example 10.

The thus-produced electrode contains 2.4% a mixed oxide of ruthenium and titanium and 1% of a mixture of paraffin and polyethylene (the mixture is a solid product at the electrode temperature during electrolysis). The electrode is tested under the conditions described in Example 10. The electrode weight loss after 10 days of tests is 54.2 g.

Example 16

A graphite electrode according to the present invention with the same dimensions as in Example 1 has a graphite base with the porosity of 20%. Into the graphite block there is introduced $Co_3O_4$ as in Example 1 and then the block is impregnated with a solution of polystyrene (80 g/l) and polymethylmethacrylate (10 g/l) in styrene stabilized with hydroquinone; the impregnation and the subsequent drying are effected just as in the case of impregnation with a solution of polystyrene in styrene in Example 1. The operation of impregnation and drying are repeated twice.

The thus-produced electrode contains 0.5% of $Co_3O_4$ and 1.5% of a mixture of polystyrene with polymethylmethacrylate (the mixture is a solid product at the electrode temperature during electrolysis). The electrode is tested under the conditions described in Example 1.

The weight loss of the electrode for the first 10 days of the experiment is 16.6 g, for the second ten days—34.7 g, for the third 10 days—37.3 g.

For a better understanding of the present invention, the results of tests of the electrodes in electrolysis of NaCl with a concentration of 280–300 g/l at a temperature of 80°–85° C. (i.e. the conditions of the production of chlorine and caustic soda) and under the conditions of the production of sodium chlorate are shown in Table 1 and 2, respectively.

The above-given Examples show that the electrode according to the present invention features considerable advantages over the prior art graphite electrodes; the effect of diminution of the rate of wear of the electrode is not an adding-up effect. Thus, for the prior art electrodes of Example 1 a mean wear rate over the period of from 20 to 30 days after the beginning of the experiment (the period during which the rate of wear is close to a stationary one) is respectively 90.9% and 66.7% of the mean rate of wear of the untreated graphite electrode within the same period. The combination of an electrocatalytic compound and an inert organic compound in pores of the electrode would allow a suggestion that the wear rate be equal to 60.6% of the rate of wear of the untreated electrode, whereas it was actually equal to only 47.4%, i.e. it turned to be by almost 1.3 times smaller which was quite unexpected. However, still more unexpected is the diminution, by several times, of the stationary rate of wear of the electrode upon combination of known impregnation agents in such amounts that when taken separately each of them either provides an insignificant positive effect or even results in a more rapid wear. Thus, the introduction of 0.5% of $Co_3O_4$ (Example 1) lowers the stationary rate of wear by 1.1 time; the introduction of 9% of polystyrene (Example 2) or 9% of OPB (Example 3) results in a drastic increase of the wear rate to a critical value; nevertheless, the stationary rate of wear of the electrode containing 0.5% of $Co_3O_4$ and 9% of polystyrene (Example 2) or 0.5% of $Co_3O_4$ and 9% of OPB (Example 3) turned to be by 3.5 times smaller than that in the case of the untreated electrode.

TABLE 1

Results of tests of electrodes with a graphite base with the porosity of 20% under the conditions of electrolysis of solutions of NaCl of a concentration 280–300 g/l at 80–85° C.

| Example No. | Electrocatalytic additive | Inert organic compound | Wear of anode (g) over the test period days | | |
|---|---|---|---|---|---|
| | | | 0–10 | 10–20 | 20–30 |
| 1 | 2 | 3 | 4 | 5 | 6 |
| 1* | — | — | 55.2 | 75.0 | 82.1 |
| 1* | 0.5% of $Co_3O_4$ | — | 18.7 | 53.5 | 74.6 |
| 1* | — | 1.5% of polystyrene | 31.3 | 49.2 | 54.8 |
| 1 | 0.5% of $Co_3O_4$ | 1.5% of polystyrene | 15.3 | 34.4 | 38.9 |
| 2* | — | 9% of polystyrene | Total breakdown | — | — |
| 2 | 0.5% of $Co_3O_4$ | 9% of polystyrene | 17.2 | 21.4 | 21.6 |
| 3* | — | 9% of oxidized petroleum bitumen | Total breakdown | — | — |
| 3 | 0.5% of $Co_3O_4$ | 9% of oxidized petroleum bitumen | 19.3 | 21.6 | 21.7 |
| 4 | 1.3% ($TiO_2$ + $RuO_2$) | 10% of polyester resin | 18.3 | 23.2 | 25.4 |
| 8 | 0.3% ($Fe_3O_4$ + $RuO_2$) | 10% of polyesteracrylate | 20.2 | — | — |
| 9 | 0.5% ($MnO_2$ + $Co_3O_4$) | 7% of phenol-formaldehyde resin | 18.5 | 20.2 | 20.6 |
| 12 | 0.5% of Pt | 2% of polyvinylchloride | 16.7 | 31.3 | 33.2 |
| 14 | 0.5% ($Al_2O_3$ + $Co_3O_4$) + 0.2% $RuO_2$ | 11% of a coal-tar pitch | 22.5 | — | — |
| 16 | 0.5% $Co_3O_4$ | 1.5% of a mixture of polystyrene with polymethylmethacrylate | 16.6 | 34.7 | 37.3 |

*Prior art electrodes

TABLE 2

Results of tests of electrodes with a graphite base having porosity of 27% under the conditions of preparation of sodium chlorate

| Example No. | Electrocatalytic additive | Inert organic compound | Wear of anode (g) over the test period (days) | | |
|---|---|---|---|---|---|
| | | | 0–10 | 10–20 | 20–30 |
| 6* | | — | 2.4 | 2.8 | 4.6 |
| 6* | 8% of $Co_3O_4$ | — | 1.5 | 2.7 | 4.6 |
| 6* | — | 3% of a product of polymerization of tall drying oil | 1.1 | 1.9 | 2.4 |

TABLE 2-continued

Results of tests of electrodes with a graphite base having porosity of 27% under the conditions of preparation of sodium chlorate

| Example No. | Electrocatalytic additive | Inert organic compound | Wear of anode (g) over the test period (days) 0–10 | 10–20 | 20–30 |
|---|---|---|---|---|---|
| 6 | 8% of $Co_3O_4$ | 3% of product of polymerization of tall stand oil | 0.9 | 1.2 | 1.3 |
| 7 | 8% of $Co_3O_4$ | 3% of a product of copolymerization of tall oil and lin-seed oil | 0.7 | 1.3 | 1.5 |
| 13 | 0.1% $SiO_2$, 0.2% $RuO_2$ | 1.2% of polymethylmethacrylate | 1.0 | 1.5 | 1.7 |

*Prior art electrodes

What is claimed is:

1. An electrode for the electrolysis of liquid electrolytes consisting of a porous graphite base having at least a portion of the pores of said base impregnated with a first layer of an electrocatalytic material comprising 0.2–8% of metals or metal compounds and being in electrical contact with said graphite and a second layer of an electrochemically inert organic compound insoluble in the electrolyte in which said electrode is utilized, said second layer covering said first layer and substantially filling the pores of said graphite base, said organic compound having a dropping point and/or a point of transition to the gas state above the electrode temperature during the electrolysis.

2. The electrode according to claim 1, wherein the organic compound comprises a substance selected from the group consisting of carbochain polymers, heterochain polymers, naturally-occurring and synthetic resins, bitumens, pitches, products of curing of curable oils and stand oils, and a mixture of said compounds.

3. The electrode for electrochemical processes according to claim 2, wherein use is made of a product selected from the group consisting of a product of curing of linseed oil, a product of curing of tall oil, a product of copolymerization of tall oil and linseed oil and a product of curing of tall stand oil.

4. An electrode for electrochemical processes, according to claim 2, which comprises use of a product selected from the group consisting of polymethylmethacrylate, and polyesteracrylate.

5. An electrode for electrochemical processes according to claim 2, which comprises use of a product selected from the group consisting of a phenol-formaldehyde resin, a furan resin, a polyester resin and an rosin.

6. An electrode for electrochemical processes according to claim 2, which comprises use of a product selected from the group consisting of oxidized petroleum bitumen and coal-tar pitch.

7. The electrode according to claim 2, wherein the carbochain polymer is a substance selected from the group consisting of polystyrene, polyethylene, polyvinylchloride, a mixture of polystyrene and polymethylmethacrylate and a mixture of polyethylene and paraffin.

8. The electrode according to claim 1, wherein said metal compounds are metal oxides.

9. The electrode according to claim 1, wherein said metals are selected from the group consisting of platinum, palladium, iridium, ruthenium and mixtures and alloys thereof.

10. The electrode according to claim 8, wherein said metal oxides are selected from the group consisting of oxides of platinum, palladium, iridium, ruthenium, iron, cobalt, nickel, chromium, copper, lead, manganese, mixtures thereof and mixtures thereof with metal oxides selected from the group consisting of oxides of titanium, tantalum zirconium, aluminum, bismuth, tungsten and niobium.

11. The electrode according to claim 9, wherein said metal is platinum.

12. An electrode according to claim 10, wherein said metal oxide is tricobalt tetraoxide.

13. An electrode according to claim 10, wherein said metal oxide is a mixture of oxides of ruthenium and titanium.

14. An electrode according to claim 10, wherein said metal oxide is ruthenium oxide.

15. An electrode for the electrolysis of liquid electrolytes consisting of a porous graphite base having at least a portion of the pores of said base impregnated with a first layer of an electrocatalytic material comprising 0.2–8% of a metal oxide and being in electrical contact with said graphite and a second layer of polystyrene being an electrochemically inert organic compound insoluble in the electrolyte in which said electrode is utilized, said second layer covering said first layer and substantially filling the pore of said graphite base, said organic compound having a dropping point and/or a point of transition to the gas state above the electrode temperature during the electrolysis.

* * * * *